US007214915B2

(12) United States Patent
Yamaguchi et al.

(10) Patent No.: US 7,214,915 B2
(45) Date of Patent: May 8, 2007

(54) HIGH FREQUENCY HEATING APPARATUS

(75) Inventors: Takahide Yamaguchi, Kashiba (JP); Koji Yamamoto, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 313 days.

(21) Appl. No.: 10/739,075

(22) Filed: Dec. 19, 2003

(65) Prior Publication Data

US 2004/0149752 A1 Aug. 5, 2004

(30) Foreign Application Priority Data

Dec. 20, 2002 (JP) ..... 2002-370340
Feb. 7, 2003 (JP) ..... 2003-031229

(51) Int. Cl.
*H05B 6/64* (2006.01)

(52) U.S. Cl. ..... 219/757; 219/702; 219/704; 219/705; 219/710; 219/711; 219/715; 219/723

(58) Field of Classification Search ..... 219/702, 219/704–5, 710–11, 715–16, 723, 720, 757
See application file for complete search history.

(56) References Cited

U.S. PATENT DOCUMENTS 4,614,036 A 9/1986 Haraguchi ..... 30/200
6,677,562 B2 * 1/2004 Oshima et al. ..... 219/710

FOREIGN PATENT DOCUMENTS

| | | |
|---|---|---|
| EP | 0928670 | 7/1999 |
| EP | 1216799 | 6/2002 |
| JP | 2-244587 | 9/1990 |
| JP | 8-31562 | 2/1996 |

* cited by examiner

*Primary Examiner*—Shawntina Fuqua
(74) *Attorney, Agent, or Firm*—Bacon & Thomas, PLLC

(57) ABSTRACT

A heating apparatus includes an inverter power supply for driving the high frequency generating device, a holding member for holding the inverter power supply and cooling fan for cooling down the inverter power supply. The holding member is provided with a holding portion for holding the inverter power supply and an air guide portion for guiding cooling air from the cooling fan toward the inverter power supply, and the air guide portion covers the inverter power supply and guides the cooling air in a manner that a semiconductor switching device and a high voltage transformer of the inverter power supply are primarily cooled down.

10 Claims, 8 Drawing Sheets

HIGH FREQUENCY HEATING APPARATUS

FIELD OF THE INVENTION

The present invention relates to a high frequency heating apparatus such as a microwave oven; and more particularly, to an internal structure of a high frequency heating apparatus capable of effectively cooling down a semiconductor switching device and a high voltage transformer of an inverter power supply for driving a high frequency heating source such as a magnetron.

BACKGROUND OF THE INVENTION

Referring to FIGS. 8 and 9, there is illustrated a schematic cross-sectional view of a conventional high frequency heating apparatus. On a rear wall of casing 1, cooling fan 2 is mounted. Disposed above and in front of cooling fan 2 is magnetron 3 to which blast duct 5 for guiding cooling air to heating chamber 4 and air guide 6 for guiding cooling air to magnetron 3 are mounted. Disposed under magnetron 3 is inverter power supply 7 on which semiconductor switching device 8 and high voltage transformer 9 are mounted adjacent to cooling fan 2. Cooling guide 10 is provided on another at a side portion of inverter power supply 7. Some of cooling air blown from cooling fan 2 is guided to magnetron 3 by air guide 6 to flow into heating chamber 4 through blast duct 5. In the meanwhile, the remainder of the cooling air is directed toward inverter power supply 7 to flow along a path defined by the surface of inverter power supply 7 on which semiconductor switching device 8 and high voltage transformer 9 are mounted and, cooling guide 10 disposed on the outer side portion of the inverter power supply 7 adjacent to casing 1 and a sidewall of heating chamber 4, so that it cools down semiconductor switching device 8 and high voltage transformer 9 of inverter power supply 7 (see, for example, Japanese Patent Laid-Open Publication No. H2-244587).

Further, as shown in FIG. 10, there has been proposed another conventional high frequency heating apparatus wherein a cooling air produced by cooling fan 103 is axially directed by orifice 104 to cool down magnetron 101 and inverter power supply 102 (see, for example, Japanese Patent Laid-Open Publication No. H8-31562).

Nowadays, in order to satisfy demands for fast cooking, the heat output of the high frequency heating apparatus is increased by an increase in input power, thereby resulting in an increase in heat generated by the semiconductor switching device and a semiconductor rectifying device of the inverter power supply.

However, in such a conventional structure in which the cooling air uniformly flows throughout the inverter power supply, it is difficult to effectively suppress an increased heat generation of the semiconductor switching device and the semiconductor rectifying device of the inverter power supply due to the increased output, which may cause thermal failures thereof, thereby leading to a malfunction of the inverter power supply.

For example, in case semiconductor switching device 8 and high voltage transformer 9 are not enclosed by a top cover, the flow rate of the cooling air flowing along sidewalls of an airflow path tends to be greater than that of the cooling air along semiconductor switching device 8 and high voltage transformer 9 and some of the cooling airflows above semiconductor switching device 8 and high voltage transformer 9. Accordingly, semiconductor switching device 8 and high voltage transformer 9 cannot be cooled down efficiently.

Further, as the output of inverter power supply 7 becomes higher in order to speed up cooking, the heat generation due to switching loss of semiconductor switching device 8 is increased. The increased heat generation, however, cannot be sufficiently cooled down in such a conventional structure, and therefore, the thermal failure of the semiconductor switching device 8 is likely to occur rather frequently. Accordingly, a time period during which the high output is produced becomes short, thus failing to achieve the fast cooking.

Alternatively, because of the heat generation due to the switching loss of semiconductor switching device 8, cooling fins for radiating heat therefrom are required to be larger. Further, since temperature of winding of high voltage transformer 9 becomes higher, the diameter of the winding is required to be greater, which makes high voltage transformer 9 bulky.

Accordingly, in such a case, inverter power supply 7 and hence the high frequency heating apparatus becomes undesirably larger. In addition, since a blowing capacity of cooling fan 2 should be increased, wind noise becomes also undesirably increased.

SUMMARY OF THE INVENTION

It is, therefore, a primary object of the present invention to provide a high frequency heating apparatus capable of cooling down effectively an inverter power supply without increasing capacity of a cooling device.

It is another object of the present invention to provide a high frequency heating apparatus capable of realizing a high output of the inverter power supply by increasing a cooling efficiency sufficient enough to prevent the inverter power supply from overheating due to the high output thereof.

It is still another object of the present invention to provide a high frequency heating apparatus in which a holding member is provided with a holding portion for holding the inverter power supply and an air guide portion for guiding a cooling air toward the inverter power supply in order to cool down electric components of the inverter power supply, wherein the air guide portion covers the inverter power supply and a high voltage transformer and, at the same time, guides the cooling air in such a manner that the semiconductor switching device and the high voltage transformer of the inverter power supply are primarily cooled down. As previously described, the semiconductor switching device and the high voltage transformer are exposed to a sufficient amount of the cooling air efficiently enough to be cooled down effectively. Thus, any thermal failure of the semiconductor switching device due to a switching loss is prevented. Moreover, an increase in temperature of a winding of the high voltage transformer is suppressed.

Accordingly, since the cooling air of increased wind speed and wind pressure is blasted primarily to heat emitting components and hot components of the high frequency heating apparatus, cooling effect is improved. Moreover, louder noise owing to an increase in the capacity of the cooling device is prevented. Further, since the length of time during which the inverter power supply produces a high output is increased without enlarging the inverter power supply, cooking time can be reduced.

In accordance with a preferred embodiment of the invention, there is provided the holding member having a holding portion for holding the inverter power supply and an air guide portion for guiding cooling air from the cooling fan toward the inverter power supply in order to cool down electric components of the inverter power supply, wherein the air guide portion covers the inverter power supply and guides the cooling air in a manner that the semiconductor switching device of the inverter power supply is primarily cooled down.

In accordance with the appliance of the present invention, a sufficient amount of cooling air is rapidly supplied to the semiconductor switching device of the inverter power supply, and thus, the semiconductor switching device of the inverter power supply is effectively cooled down.

In accordance with another preferred embodiment of the present invention, there is provided the holding member having a holding portion for holding the inverter power supply and an air guide portion for guiding cooling air from the cooling fan toward the inverter power supply in order to cool down electric components of the inverter power supply, wherein the air guide portion covers the inverter power supply and guides the cooling air in a manner that the semiconductor switching device and the high voltage transformer of the inverter power supply are primarily cooled down.

In accordance with the appliance described above, a sufficient amount of the cooling air is rapidly supplied to the semiconductor switching device and the high voltage transformer of the inverter power supply, and thus, they are effectively cooled down.

Preferably, one side wall of the air guide portion is connected to one side wall of the holding portion via a bendable portion of a less thickness, and the other side wall of the air guide portion has an engaging portion, which is engaged with a counterpart engaging portion formed on the other side wall of the holding portion, so that the air guide portion covers the inverter power supply.

As a result, the cooling air rarely leaks through left and right sides of the holding member, so that the cooling effect is not deteriorated. Moreover, the holding portion and the air guide portion are simply joined to become a single body.

Preferably, side walls of the air guide portion are engaged with corresponding side walls of the holding portion, respectively, so that the air guide portion covers the inverter power supply.

As a result, the cooling air rarely leaks through left and right sides of the holding member for airtight joining of walls of the holding member, so that the cooling effect is not deteriorated. Moreover, the holding portion and the air guide portion are simply and easily joined to become a single body.

Preferably, the air guide portion has a cutaway portion through which a high voltage lead wire electrically connecting the inverter power supply to the high frequency generating device is extended and held thereby.

As a result, the high voltage lead wires connecting the inverter power supply to a magnetron are held in a cutaway portion, so that the high voltage lead wires are prevented from making a contact with the cooling fan adjacent to the inverter power supply.

Preferably, the holding portion has an L-shaped engaging portion which is engaged with a bottom plate of the apparatus.

And, according to the aforementioned structural features, the holding member is simply and readily fixed to a casing of the high frequency heating apparatus as a separate unit.

In accordance with still another embodiment of the present invention, there is provided a high frequency heating apparatus, including: an inverter power supply having a cooling fin; a magnetron for generating a microwave energy, the magnetron being supplied with an electric power from the inverter power supply; a cooling device for cooling down the inverter power supply and the magnetron; and an air guide portion for rectifying cooling air from the cooling device, the air guide portion including an inner partition which is inclined so as to define a convergent passage in a direction of airflow.

In accordance with the appliance described above, the wind speed and wind pressure of the cooling air are increased to thereby improve the cooling effect. Moreover, since the wind speed and wind pressure of the cooling air is increased sectionally, the cooling air works effectively as if it is produced by a cooling device of a greater capacity, while louder noise that may be generated in case the capacity of the cooling device is increased can be prevented.

Preferably, the cooling air passing through the convergent passage comes to flow through a cooling fin member. Thus, the cold cooling air with the increased wind speed and wind pressure by the slanted inner partition of the air guide portion first flows to the cooling fin before being heated by other heat emitting components, so that it cools down the cooling fin effectively. That is, since the cold cooling air of the increased wind speed and wind pressure is primarily and effectively blown to the cooling fin, the cooling effect on the cooling fin, and semiconductor switching device and rectifying device on the cooling fin is significantly improved. Moreover, since the wind speed and wind pressure of the cooling air are increased sectionally, such a cooling air obtained works effectively as if it is produced by a cooling device of a greater capacity. Further, louder noise that can be generated in case the capacity of the cooling device is increased can be prevented.

Preferably, the air guide portion is formed of a resin material and a portion of the air guide portion is folded to form the inclined inner partition. At this time, if a thinner portion is introduced in the bendable portion, the bendable portion becomes more flexible, so that bending process can be easily performed.

As described above, by folding the one part of the air guide portion, the inner partition is formed in such a way that the cooling air passage can be converged. Thus, molds for producing air guide portion can be simplified, which in turn leads to a reduction in time spent on forming the air guide portion.

Preferably, the cooling device has a propeller fan, and the air guide portion is configured to divide the cooling air blown from the propeller fan into an upper stream and a lower stream with respect to about an axle of the propeller fan and guide the lower stream to the convergent passage. If the magnetron for producing a microwave energy is heated at a predetermined temperature, moding or explosion thereof can occur, leading to a breakdown of the magnetron. To prevent such a breakdown, the magnetron is cooled down by the cooling air from a portion of the cooling fan above an axle thereof. As previously noted, the inverter power supply is cooled down by the cooling air from a portion of the cooling fan below the axle thereof and the magnetron is cooled down by the cooling air from the portion of the cooling fan above the axle thereof. Thus, the reliability of the inverter power supply and the magnetron is improved.

Preferably, the air guide portion has an outer partition which is inclined to divide the cooling air blown from the propeller fan into the upper stream and the lower stream and guide the lower stream into the convergent passage. The cooling air produced by the propeller fan, the cooling device, is first divided into upper and lower streams by the outer partition. As the lower stream flows further away from the inlet of the passage, a cross sectional area of the passage is reduced, causing wind speed and wind pressure of the lower stream to be increased. Thus, cooling effect of the inverter power supply is further improved.

Further, when the upper stream flows over the outer partition, a negative pressure region occurs due to the inclination of the outer partition to the upper stream, deflecting the upper stream downward. As a result, the cooling air is more effectively supplied to the magnetron.

Preferably, the air guide portion is formed in one piece with a holding portion for holding the inverter power supply. The relative positions of heat emitting components and hot components, such as the cooling fin of the inverter power supply, and semiconductor switching device and semiconductor rectifying device on the cooling fin, to the air guide portion are fixed. Thus, the cooling air of increased wind speed and wind pressure by passing through the convergent passage whose cross sectional area is reduced with a distance from the inlet thereof, is certainly blown to the cooling fin of the inverter power supply, and the semiconductor switching device and the semiconductor rectifying device on the cooling fin. Accordingly, the cooling effect is improved.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Preferred embodiments of the present invention will now be described in detail with reference to the accompanying drawings.

Embodiment 1

Figure 1:
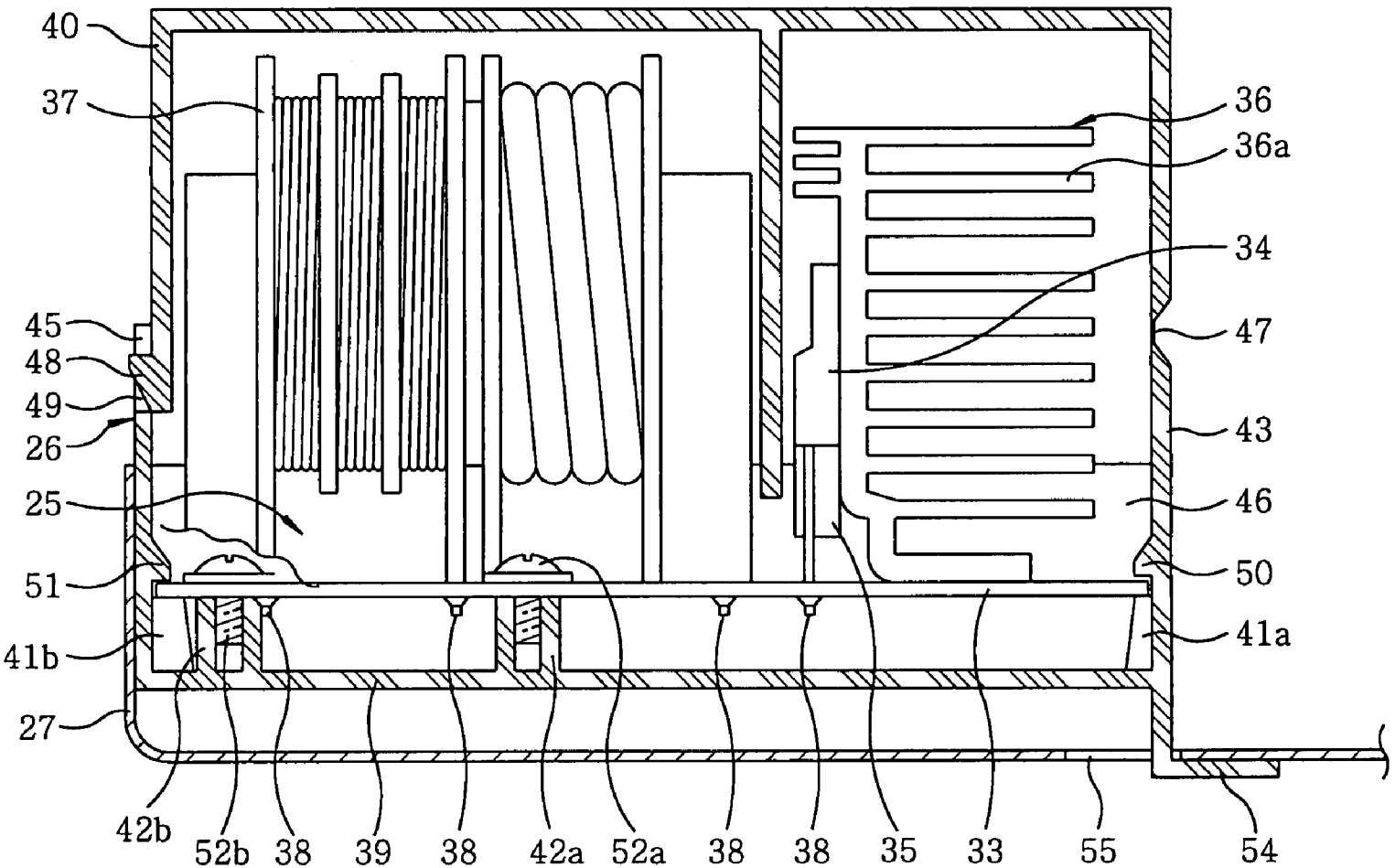
FIG. 1 is a cross sectional view of main parts of a high frequency heating apparatus in accordance with a first embodiment of the present invention.
Figure 2:
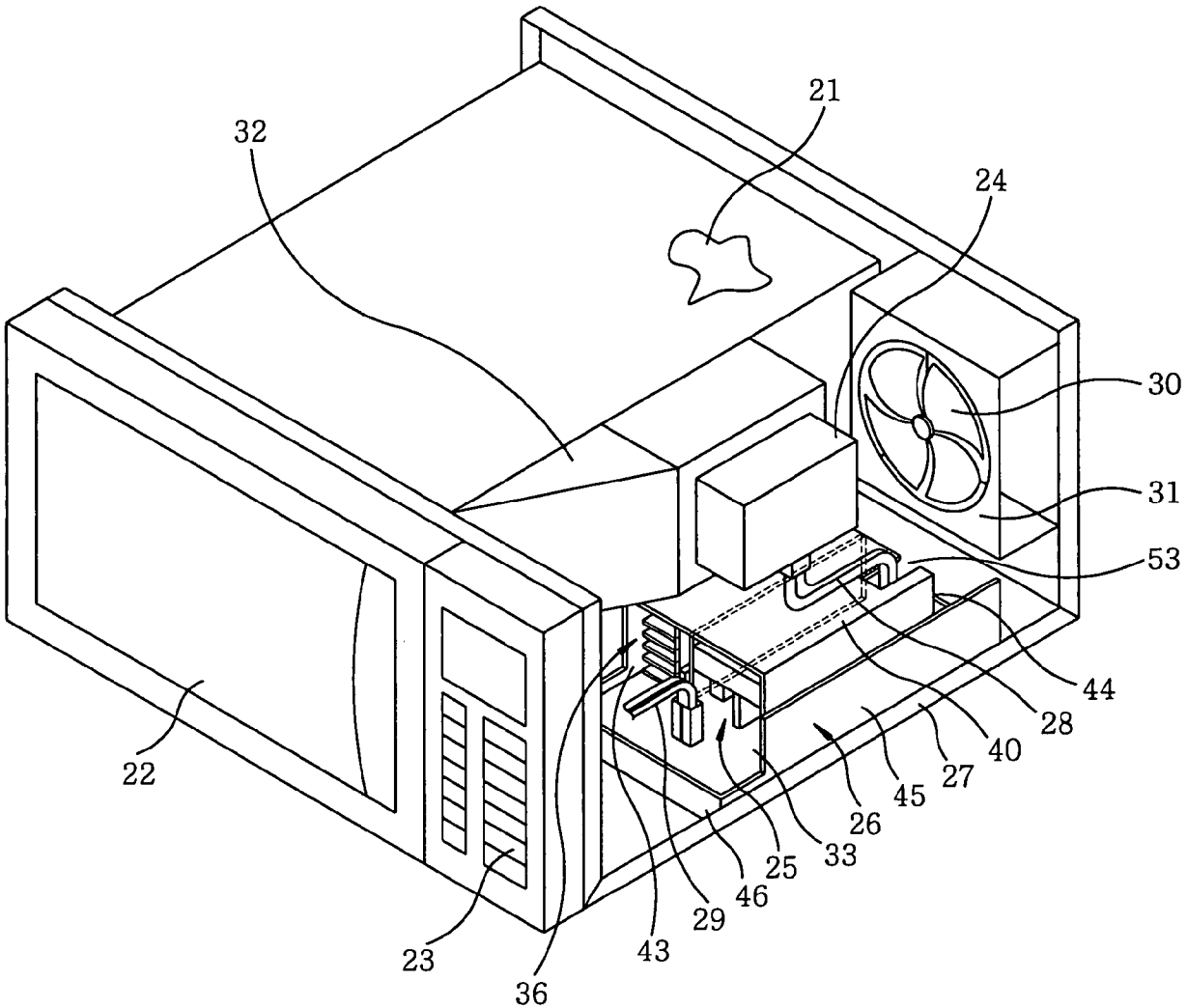
FIG. 2 presents a perspective view showing an external appearance of the high frequency heating apparatus of the first preferred embodiment with its casing (not shown) removed.

FIG. 1 illustrates a cross sectional view of main parts of a high frequency heating apparatus in accordance with a first embodiment of the present invention. FIG. 2 describes a perspective view showing an external appearance of the high frequency heating apparatus of the first preferred embodiment with its casing (not shown) removed.

As shown in FIGS. 1 and 2, mounted at a front side of heating chamber 21 is door 22 for opening and closing heating chamber 21. Control panel 23 for setting heat output, heating time and the like is disposed beside door 22. Magnetron 24 is mounted on a right side wall of heating chamber 21. Under magnetron 24, inverter power supply 25 is secured to holding member 26, which is fixed on bottom plate 27 of the high frequency heating apparatus. Inverter power supply 25 is connected to magnetron 24 via high voltage lead wires 28 for supplying high voltage thereto. Inverter power supply 25 is also connected to a control board of control panel 23 through low voltage lead wires 29, and drives magnetron 24 in response to a control signal from control panel 23. Behind magnetron 24 and inverter power supply 25, cooling fan 30 and fan duct 31 are mounted, so that cooling air blown from cooling fan 30 cools down magnetron 24, inverter power supply 25, electronic components (not shown) and electric components (not shown). Disposed in front of magnetron 24 is air guide 32 which guides the cooling air passing through magnetron 24 into heating chamber 21. The cooling air introduced into heating chamber 21 is discharged therefrom with vapor generated from heated food. Installed at the left side on an upper surface of printed circuit board 33 of inverter power supply 25 is cooling fin member 36 (see FIG. 2) on which semiconductor switching device 34 and rectifying device 35 are attached, and at the right side thereon is high voltage transformer 37 for producing high voltage. Mounted on printed circuit board 33 are electronic components (not shown) and electric components (not shown) which, as shown in FIG. 1, are electrically connected by solders 38 to thin copper pattern formed on a lower surface of printed circuit board 33. Cooling fin member 36 is provided at one side face thereof with a plural number of fins 36*a*. Semiconductor switching device 34 and rectifying device 35 are attached to the other flat face of cooling fin member 36. Moreover, cooling fin member 36 is made of aluminum to facilitate emission of heat generated from semiconductor switching device 34 and rectifying device 35. Holding member 26 is provided with holding portion 39 for holding inverter power supply 25 and air guide portion 40 for guiding the cooling air toward cooling fin member 36 coupled with semiconductor switching device 34 and rectifying device 35, and high voltage transformer 37. Formed on a bottom portion of holding portion 39 are ribs 41*a*, 41*b*, and bosses 42*a*, 42*b* for supporting printed circuit board 33. Further, four walls 43, 44, 45 and 46 are vertically installed to surround edges of printed circuit board 33. Continuously connected to an upper end portion of wall 43 is air guide portion 40 having substantially E-shaped configuration in section. Wall 43 and air guide portion 40 are connected by bendable portion 47 having a smaller thickness. Air guide portion 40 covers high voltage transformer 37 and cooling fin member 36 coupled with semiconductor switching device 34 and rectifying device 35 to form a duct through which cooling air flows. Air guide portion 40 has at one end portion hook 48 which is fitted into rectangular aperture 49. Walls 43 and 45 of holding portion 39 have protrusions 50 and 51, respectively, which bear on periphery portions of printed circuit board 33 of inverter power supply 25, so that inverter power supply 25 is held between protrusions 50, 51, and ribs 41*a*, 41*b* and bosses 42*a*, 42*b*. Printed circuit board 33 is fixed to bosses 42*a*, 42*b* of holding portion 39 by fitting screws 52*a*, 52*b* into bosses 42*a*, 42*b*, respectively from the upper surface of printed circuit board 33 on which the electronic and electric components are mounted.

Air guide portion 40 has on the side of cooling fan 30 cutaway portion 53 through which high voltage lead wires 28 electronically connecting inverter power supply 25 to magnetron 23 are extended and held thereby, so that high voltage lead wires 28 are prevented from making a contact with cooling fan 30.

L-shaped hook 54 is formed on a lower surface of a base of holding portion 39, and holding member 26 is fixed to bottom plate 27 by fitting L-shaped hook 54 into rectangular aperture 55 formed in bottom plate 27.

Assembling process of inverter power supply 25 to holding member 26 will now be described.

First, a side periphery portion of printed circuit board 33 adjacent to high voltage transformer 37 of inverter power supply 25 is inserted into a gap between rib 41*b* and protrusion 51 formed on wall 45 of holding member 26. Then, the opposite side periphery portion of printed circuit board 33 is inserted into a gap between rib 41*a* and protrusion 50 while elastically bending wall 43 outwardly. Next, by rotating air guide portion 40 about bendable portion 47, air guide portion 40 covers high voltage transformer 37 and cooling fin member 36 coupled with semiconductor switching device 34 and rectifying device 35, thereby forming a duct for cooling air. At this time, hook 48 of air guide portion 40 is fitted into rectangular aperture 49 in wall 45 to integrate air guide portion 40 with holding portion 39. Moreover, after being aligned with holding portion 39, printed circuit board 33 is fixed thereto by inserting screws 52*a*, 52*b* into bosses 42*a*, 42*b* from the upper surface of printed circuit board 33 on which the electronic and electric components are mounted. Then, holding member 26 is fixed to bottom plate 27 by fitting L-shaped hook 54 formed on the lower surface of the base of holding portion 39 into rectangular aperture 55 in bottom plate 27.

Operation of the high frequency heating apparatus of the first embodiment will now be described.

As shown in FIG. 1, the cooling air blown from cooling fan 30 flows through gaps defined between air guide portion 40 of holding member 26 and cooling fin member 36 coupled with semiconductor switching device 34 and rectifying device 35, and between air guide portion 40 and high voltage transformer 37. At this time, since the cooling air flows through the gaps without escaping therefrom, flow rate of the cooling air increases as it flows through the narrower gaps. That is, the cooling air flows at a higher speed around cooling fin member 36 coupled with semiconductor switching device 34 and rectifying device 35, and around high voltage transformer 37. Moreover, since the cooling air flows directly toward cooling fin member 36 coupled with semiconductor switching device 34 and rectifying device 35, and high voltage transformer 37, heat generated by semiconductor switching device 34 and high voltage transformer 37 can be dissipated quickly, thereby improving cooling effect.

Further, since hook 48 of air guide portion 40 is fitted into rectangular aperture 49 formed in wall 45, the gaps defined between air guide portion 40 of holding member 26, and cooling fin member 36 coupled with semiconductor switching device 34 and rectifying device 35, and between air guide portion 40 and high voltage transformer 37 can be maintained stably. Accordingly, heat radiation effects of cooling fin member 36 coupled with semiconductor switching device 34 and rectifying device 35, and high voltage transformer 37 can also be stably maintained.

Moreover, since air guide portion 40 is continuously connected to the upper end portion of wall 43 by bendable portion 47, i.e., the thin recessed portion, the gaps defined between air guide portion 40 of holding member 26 and cooling fin member 36 coupled with semiconductor switching device 34 and rectifying device 35, and between air guide portion 40 and high voltage transformer 37 can be simply obtained by pivoting air guide portion 40 about bendable portion 47.

Embodiment 2

Figure 3:
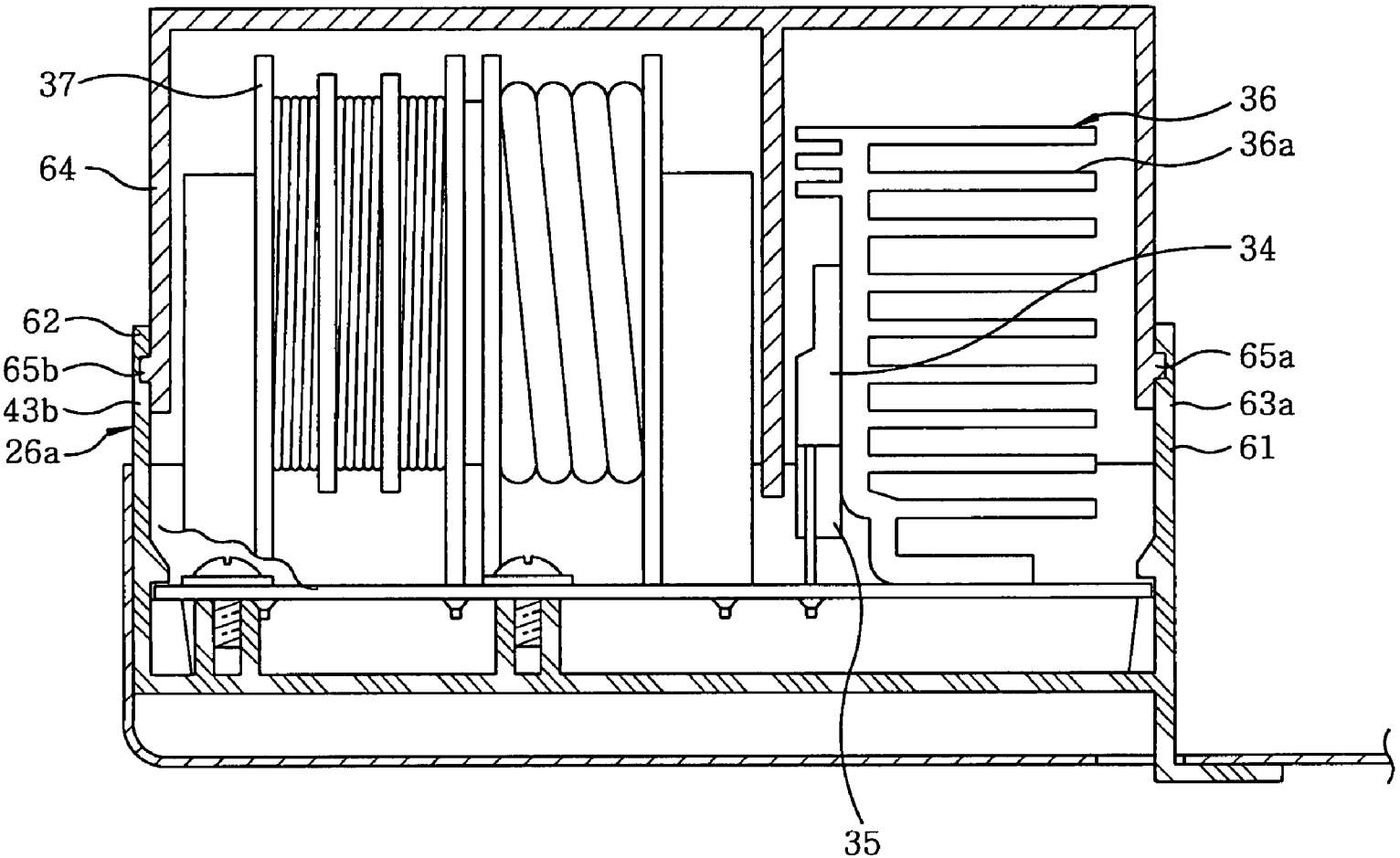
FIG. 3 depicts a cross sectional view of main parts of a high frequency heating apparatus in accordance with a second embodiment of the present invention.

Referring to FIG. 3, there is shown a cross sectional view of main parts of a high frequency heating apparatus in accordance with a second embodiment of the present invention, wherein like parts to those of the first embodiment are represented by like reference characters and detailed descriptions thereof will be omitted.

Disposed vertically on both sides of holding member 26*a* are walls 61 and 62 which have at their top end portions recessed engaging portions 63*a* and 63*b*, respectively. In order to efficiently cool down cooling fin member 36 coupled with semiconductor switching device 34 and rectifying device 35, and high voltage transformer 37, air guide portion 64 having a substantially E-shaped configuration in section is introduced, which has at its both end portions protruded engaging portions 65*a*, 65*b*. Protruded engaging portions 65*a*, 65*b* of air guide portion 64 are engaged with corresponding recessed engaging portions 63*a* and 63*b* of walls 61, 62 in such a manner that air guide portion 64 covers cooling fin member 36 coupled with semiconductor switching device 34 and rectifying device 35, and high voltage transformer 37, thereby defining gaps between air guide portion 64 and cooling fin member 36 coupled with semiconductor switching device 34 and rectifying device 35, and between air guide portion 64 and high voltage transformer 37. With such an arrangement, since air guide portion 64 and walls 61, 62 of holding member 26*a* are air-tightly engaged with each other, any leakage of cooling air from the sides of holding member 26*a* is prevented and therefore cooling effect is not deteriorated. Moreover, holding member 26*a* and air guide portion 64 are simply and easily joined together.

Further, it should be noted that the configuration of air guide portion 40 is not limited to that shown in the drawings and modifications can be made thereto as long as the relationships of air guide portion 40 with cooling fin member 36 coupled with semiconductor switching device 34 and rectifying device 35, and high voltage transformer 37 ensure that the flow rate of the cooling air increases and there is no leakage of cooling air from the sides of holding member 26*a*.

Moreover, it should also be noted that the recessed or protruded engaging portions of walls 61 and 62 or air guide portion 64 may be modified as long as the cooling air does not leak through the joints thereof.

Further, it should be also noted that cutaway portion 53 of air guide portion 40 may have various shapes as long as it can firmly hold high voltage lead wires 28.

Further, it should be also noted that, although holding member 26*a* is mounted on bottom plate 27 in this embodiment, it may be mounted on another component other than bottom plate 27 while achieving same effects.

Moreover, it should be also noted that, although holding member 26*a* is horizontally disposed in this embodiment, it may be vertically disposed while achieving same effects.

Embodiment 3

Figure 4:
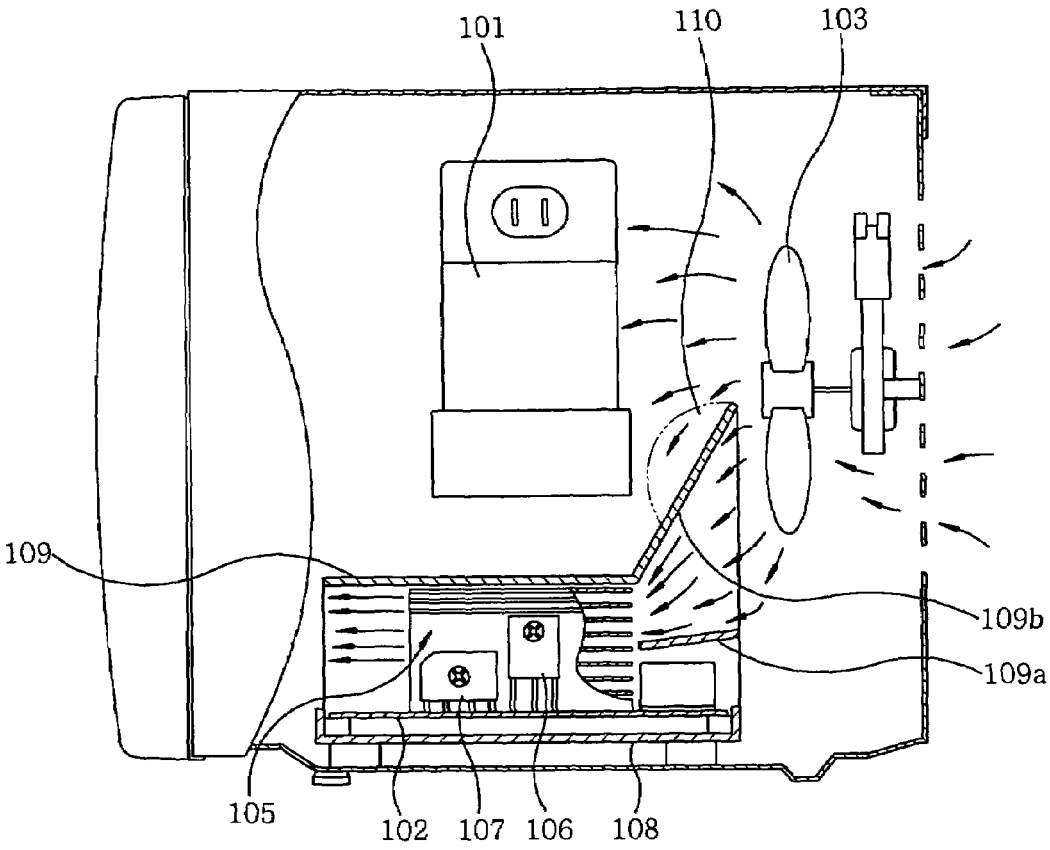
FIG. 4 offers a partial cross-sectional view of the third embodiment.
Figure 5:
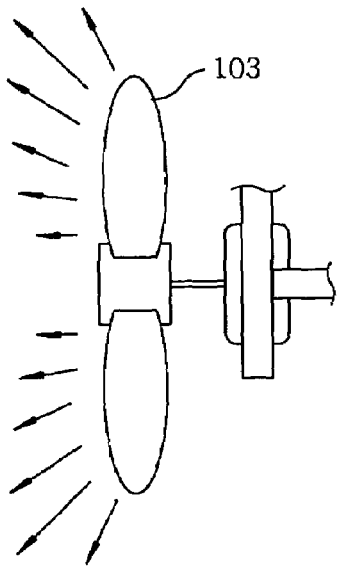
FIG. 5 sets forth the wind speed and wind pressure of cooling air blown from a cooling fan.
Figure 6:
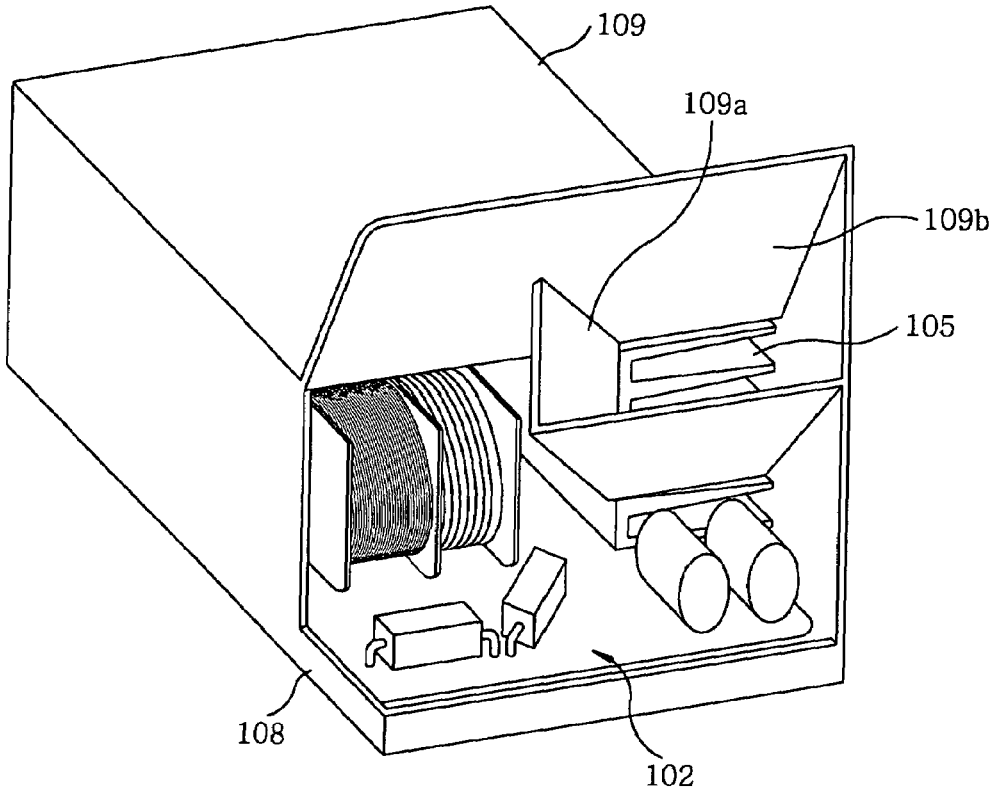
FIG. 6 releases an enlarged perspective view of an air guide portion and an inverter power supply.

Referring to FIGS. 4 to 6, there is illustrated a high frequency heating apparatus in accordance with a third embodiment of the present invention. FIG. 4 shows a partial cross-sectional view of the third embodiment; FIG. 5 displays the wind speed and wind pressure of cooling air blown from a cooling fan; and FIG. 6 sets forth an enlarged perspective view of an air guide portion and an inverter power supply.

As shown in FIG. 4, there are presented magnetron 101, inverter power supply 102 and cooling fan 103. Mounted on inverter power supply 102 is cooling fin member 105 with which semiconductor switching device 106 and semiconductor rectifying device 107 are coupled. Moreover, air guide portion 109 and holding portion 108 on which inverter power supply 102 is mounted are formed in a single body. Air guide portion 109 is provided with inner partition 109*a* and outer partition 109*b*, which form a convergent passage for guiding cooling air from cooling fan 103. Inner partition 109*a* is inclined such that a cross-sectional area of air path gradually decreases in a direction of airflow. Outer partition 109*b* is disposed so as to deflect cooling air blown from a portion of cooling fan 103 below its axle into the convergent passage.

Operation of the high frequency heating apparatus as described above, especially of cooling system for inverter power supply 102, will now be described.

The cooling air produced by cooling fan 103 is first divided into upper and lower streams with respect to the axle of cooling fan 103 by outer partition 109*b* of air guide portion 109. The upper stream is directed toward magnetron 101 and the lower stream toward air guide portion 109. Since the cross sectional area of the passage is gradually reduced in the airflow direction by inner partition 109*a* and outer partition 109*b* inclined, wind speed and wind pressure of the lower stream flowing therethrough increase. Next, the lower stream of high wind speed and wind pressure is blown to cooling fin member 105 of inverter power supply 102 from an outlet of the convergent passage to efficiently cool down cooling fin member 105, and semiconductor switching device 106 and semiconductor rectifying device 107 coupled with cooling fin member 105.

Further, as shown in FIG. 5, wind speed and wind pressure of the cooling air blown from cooling fan 103 are distributed less around the central portion of cooling fan 103 and more toward the peripheral portion thereof. Therefore, the cooling air stream from cooling fan 103 generally diverges from the cooling fan 103. When the upper stream flows over outer partition 109*b*, a negative pressure region 110 occurs near a rear surface of outer partition 109*b* facing magnetron 101, deflecting the upper stream downward. As a result of the deflection of the upper stream, the cooling air of higher wind speed and wind pressure produced from periphery portion of cooling fan 103 flows toward magnetron 101, efficiently cooling down it.

As previously described, since inner partition 109*a* and outer partition 109*b* form the convergent passage whose cross sectional area is gradually decreased in the airflow direction, the cooling air of high wind speed and wind pressure is blown to cooling fin member 105 of inverter power supply 102, and semiconductor switching device 106 and semiconductor rectifying device 107 mounted on cooling fin member 105, thereby cooling down them efficiently. Moreover, magnetron 101 is also efficiently cooled down by the cooling air of the higher wind speed and wind pressure. Accordingly, high output and great reliability of high frequency heating apparatus can be achieved.

Embodiment 4

Figure 7:
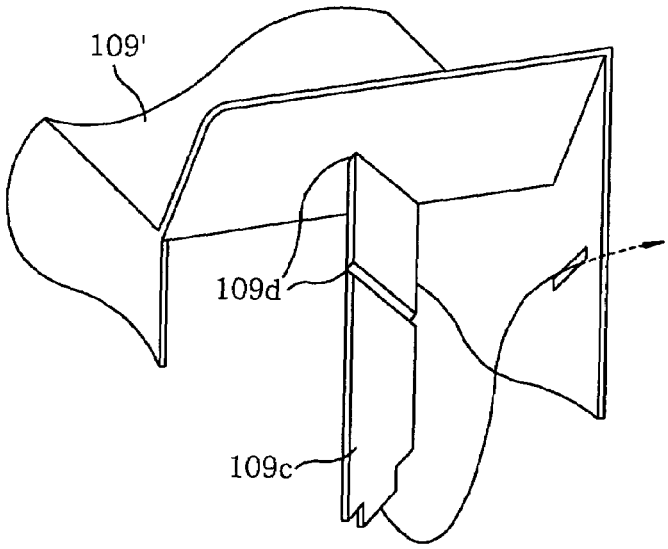
FIG. 7 exhibits an enlarged perspective view showing main parts of air guide portion in accordance with a fourth embodiment of the present invention.
Figure 8:
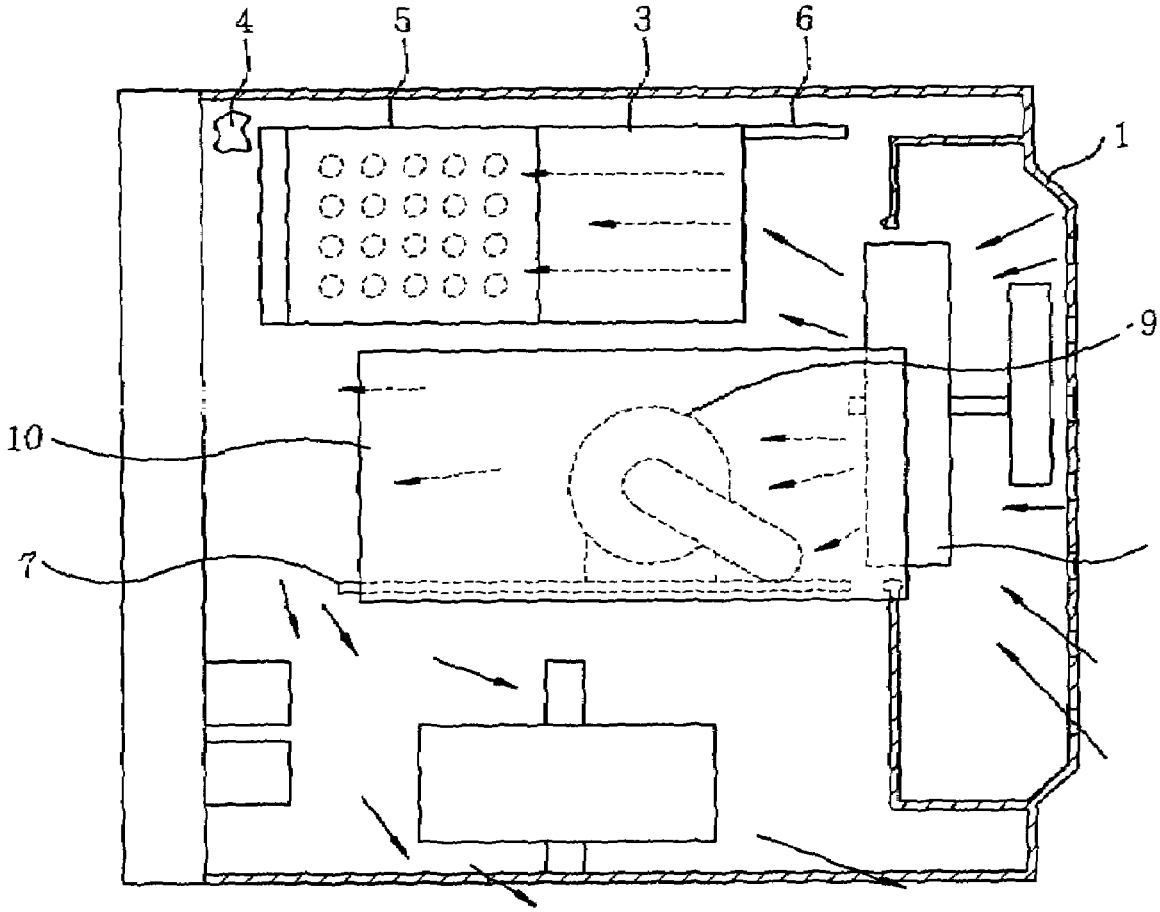
FIG.8 (PRIOR ART)
FIG. 8 charts a vertical cross-sectional view of a conventional high frequency heating apparatus.
Figure 9:
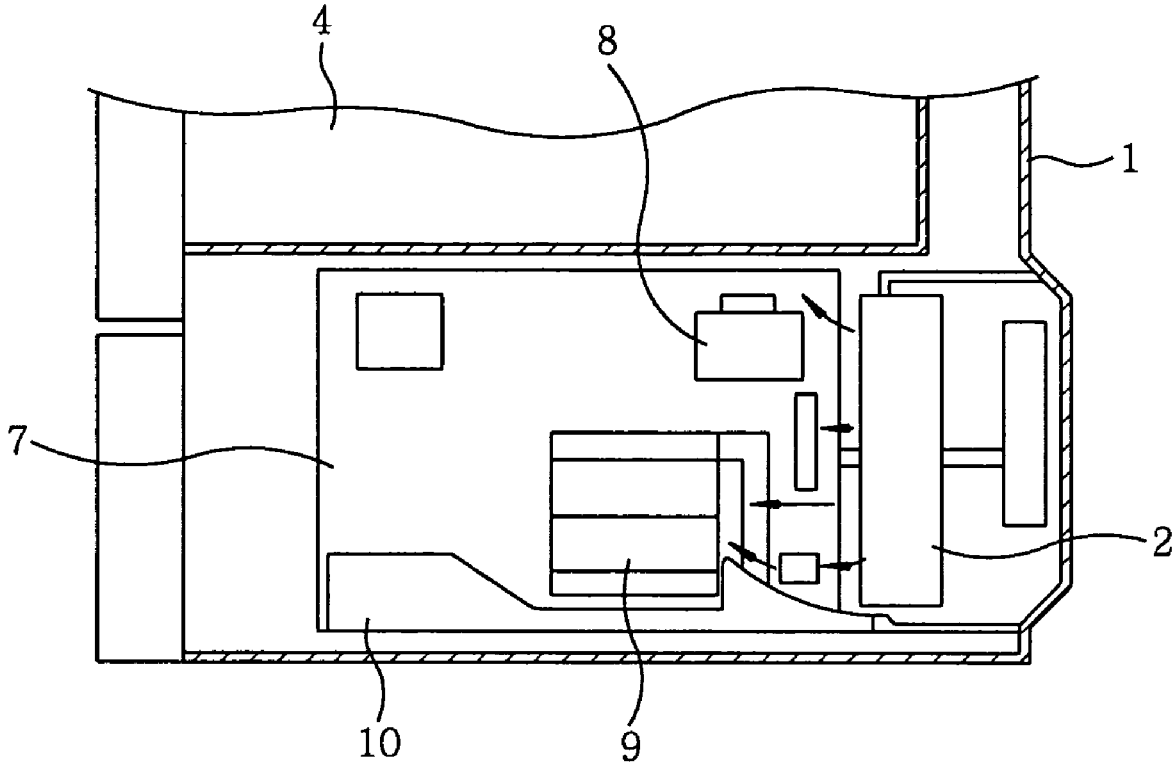
FIG. 9 (PRIOR ART)
FIG. 9 describes a horizontal cross-sectional view of the high frequency heating apparatus of FIG. 8.
Figure 10:
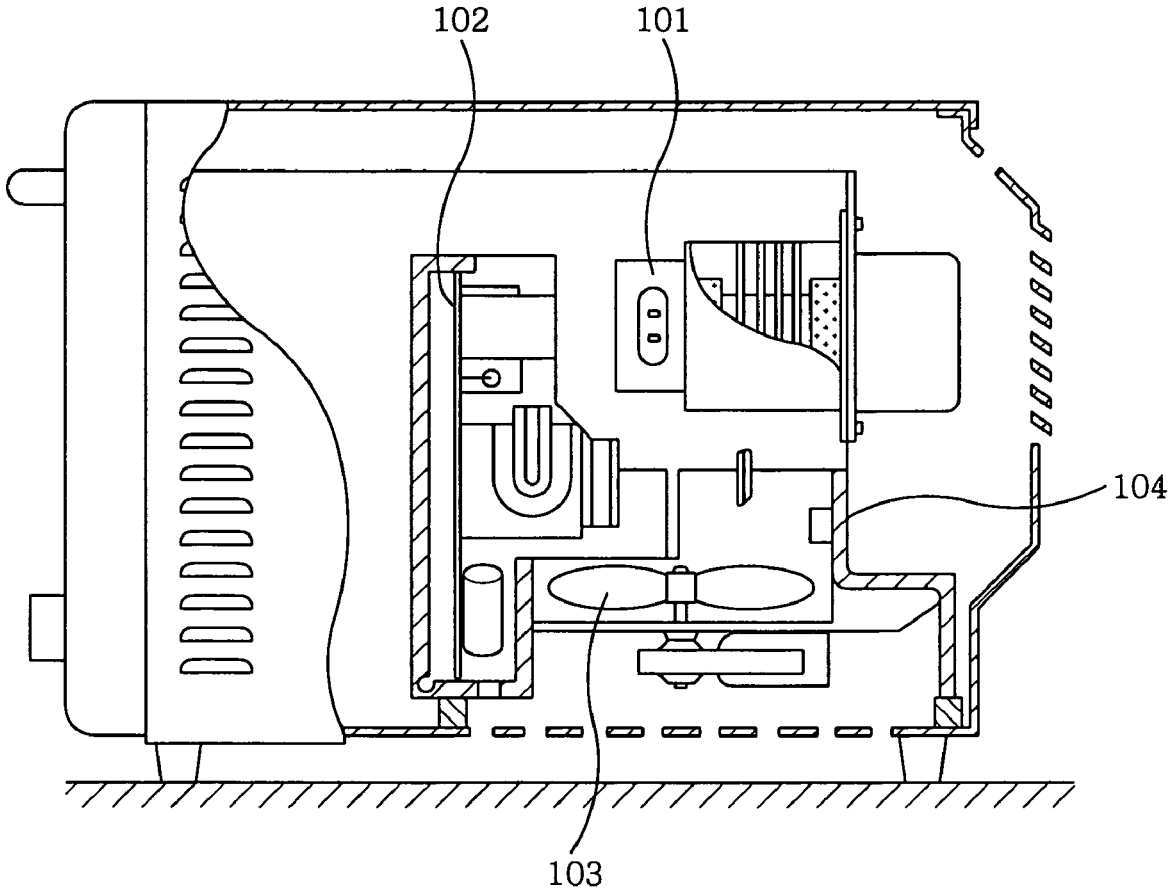
FIG. 10 (PRIOR ART)
FIG. 10 explains a vertical cross-sectional view of another conventional high frequency heating apparatus.

Referring to FIG. 7, there is illustrated an enlarged perspective view showing main parts of air guide portion in accordance with a fourth embodiment of the present invention, wherein like parts to those of the third embodiment are represented as like reference character and detailed descriptions thereof will be omitted for simplicity.

As shown in FIG. 7, the fourth embodiment is different from the third embodiment in that inner partition 109*c* is formed by folding a portion of air guide portion 109', to make a convergent passage for cooling air which is gradually getting narrower along a direction of the airflow.

Inner partition 109*c* of air guide portion 109' is first provided with hinge portion 109*d* of a less thickness for facilitating the folding of inner partition 109*c*. Thus, inner partition 109*c* is easily folded and fixed at its free end to a side wall of air guide portion 109' by, e.g., fitting a hook of the free end into a hole in the side wall such that the convergent path is formed. As a result, a mold for producing air guide portion 109' can be simplified, and this leads to a reduction in time taken to manufacture air guide portion 109'.

As previously described, since the air guide portion is configured to cover the inverter power supply and cool down primarily the semiconductor switching device and the high voltage transformer of the inverter power supply, the semiconductor switching device and the high voltage transformer can be efficiently and rapidly cooled down. Accordingly, thermal failure of the semiconductor switching device due to switching loss thereof is prevented.

Moreover, since winding of the high voltage transformer is cooled down efficiently, the time period during which high output is produced can be increased without increasing inverter power supply in magnitude. Accordingly, fast cooking is achieved.

While the invention has been shown and described with respect to the preferred embodiments, it will be understood by those skilled in the art that various changes and modifications may be made without departing from the spirit and scope of the invention as defined in the following claims.

What is claimed is:

1. A high frequency heating apparatus, comprising:

a heating chamber for accommodating an object to be heated;

a high frequency generating device for supplying a microwave energy to the heating chamber;

an inverter power supply for driving the high frequency generating device, the inverter power supply having a semiconductor switching device;

a holding member for holding the inverter power supply; and cooling fan for cooling down the inverter power supply, wherein the holding member is provided with a holding portion for holding the inverter power supply and an air guide portion for guiding cooling air from the cooling fan toward the inverter power supply in order to cool down electric components of the inverter power supply, and the air guide portion covers the inverter power supply and guides the cooling air in a manner that the semiconductor switching device of the inverter power supply is primarily cooled down, and wherein one side wall of the air guide portion is connected to one side wall of the holding portion via a bendable portion of a less thickness, and the other side wall of the air guide portion has an engaging portion, which is engaged with a counterpart engaging portion formed on the other side wall of the holding portion, so that the air guide portion covers the inverter power supply.

2. The high frequency heating apparatus of claim 1, wherein the air guide portion has a cutaway portion through which a high voltage lead wire electrically connecting the inverter power supply to the high frequency generating device is extended and held thereby.

3. The high frequency heating apparatus of claim 1, wherein the holding portion has an L-shaped engaging portion which is engaged with a bottom plate of the apparatus.

4. A high frequency heating apparatus, comprising:

a heating chamber for accommodating an object to be heated;

a high frequency generating device for supplying a microwave energy to the heating chamber;

an inverter power supply for driving the high frequency generating device, the inverter power supply having a semiconductor switching device;

a holding member for holding the inverter power supply; and cooling fan for cooling down the inverter power supply, wherein the holding member is provided with a holding portion for holding the inverter power supply and an air guide portion for guiding cooling air from the cooling fan toward the inverter power supply in order to cool down electric components of the inverter power supply, and the air guide portion covers the inverter power supply and guides the cooling air in a manner that the semiconductor switching device of the inverter power supply is primarily cooled down, and wherein the air guide portion has a cutaway portion through which a high voltage lead wire electrically connecting the inverter power supply to the high frequency generating device is extended and held thereby.

5. A high frequency heating apparatus, comprising:

a heating chamber for accommodating an object to be heated;

a high frequency generating device for supplying a microwave energy to the heating chamber;

an inverter power supply for driving the high frequency generating device, the inverter power supply having a semiconductor switching device;

a holding member for holding the inverter power supply; and cooling fan for cooling down the inverter power supply, wherein the holding member is provided with a holding portion for holding the inverter power supply and an air guide portion for guiding cooling air from the cooling fan toward the inverter power supply in order to cool down electric components of the inverter power supply, and the air guide portion covers the inverter power supply and guides the cooling air in a manner that the semiconductor switching device of the inverter power supply is primarily cooled down, and wherein the holding portion has an L-shaped engaging portion which is engaged with a bottom plate of the apparatus.

6. A high frequency heating apparatus, comprising:

a heating chamber for accommodating an object to be heated;

a high frequency generating device for supplying a microwave energy to the heating chamber;

an inverter power supply for driving the high frequency generating device, the inverter power supply having a semiconductor switching device and a high voltage transformer;

a holding member for holding the inverter power supply; and cooling fan for cooling down the inverter power supply, wherein the holding member is provided with a holding portion for holding the inverter power supply and an air guide portion for guiding cooling air from the cooling fan toward the inverter power supply in order to cool down electric components of the inverter power supply, and the air guide portion covers the inverter power supply and guides the cooling air in a manner that the semiconductor switching device and the high voltage transformer of the inverter power supply are primarily cooled down, and wherein one side wall of the air guide portion is connected to one side wall of the holding portion via a bendable portion of a less thickness, and the other side wall of the air guide portion has an engaging portion, which is engaged with a counterpart engaging portion formed on the other side wall of the holding portion, so that the air guide portion covers the inverter power supply.

7. The high frequency heating apparatus of claim 6, wherein the air guide portion has a cutaway portion through which a high voltage lead wire electrically connecting the inverter power supply to the high frequency generating device is extended and held thereby.

8. The high frequency heating apparatus of claim 6, wherein the holding portion has an L-shaped engaging portion which is engaged with a bottom plate of the apparatus.

9. A high frequency heating apparatus, comprising:

a heating chamber for accommodating an object to be heated;

a high frequency generating device for supplying a microwave energy to the heating chamber;

an inverter power supply for driving the high frequency generating device, the inverter power supply having a semiconductor switching device and a high voltage transformer;

a holding member for holding the inverter power supply; and cooling fan for cooling down the inverter power supply, wherein the holding member is provided with a holding portion for holding the inverter power supply and an air guide portion for guiding cooling air from the cooling fan toward the inverter power supply in order to cool down electric components of the inverter power supply, and the air guide portion covers the inverter power supply and guides the cooling air in a manner that the semiconductor switching device and the high voltage transformer of the inverter power supply are primarily cooled down, and wherein the air guide portion has a cutaway portion through which a high voltage lead wire electrically connecting the inverter power supply to the high frequency generating device is extended and held thereby.

10. A high frequency heating apparatus, comprising;

a heating chamber for accommodating an object to be heated;

a high frequency generating device for supplying a microwave energy to the heating chamber;

an inverter power supply for driving the high frequency generating device, the inverter power supply having a semiconductor switching device and a high voltage transformer;

a holding member for holding the inverter power supply; and cooling fan for cooling down the inverter power supply, wherein the holding member is provided with a holding portion for holding the inverter power supply and an air guide portion for guiding cooling air from the cooling fan toward the inverter power supply in order to cool down electric components of the inverter power supply, and the air guide portion covers the inverter power supply and guides the cooling air in a manner that the semiconductor switching device and the high voltage transformer of the inverter power supply are primarily cooled down, and wherein the holding portion has an L-shaped engaging portion which is engaged with a bottom plate of the apparatus.

* * * * *